United States Patent [19]

Smith

[11] 4,022,690

[45] May 10, 1977

[54] INTEGRAL PUMP SKIMMER AND FILTER UNIT FOR ABOVE-GROUND SWIMMING POOLS

[75] Inventor: Clarence G. Smith, Pomona, Calif.

[73] Assignee: Muskin Corporation, Colton, Calif.

[22] Filed: Jan. 8, 1976

[21] Appl. No.: 647,571

[52] U.S. Cl. ..... 210/169; 210/249

[51] Int. Cl.[2] ..... E04H 3/16

[58] Field of Search ..... 210/169, 249, 242, 416; 15/1.7; 4/172

[56] References Cited

UNITED STATES PATENTS

| | | | |
|---|---|---|---|
| 2,844,255 | 7/1958 | Cavenah | 210/169 X |
| 2,900,079 | 8/1959 | Pace | 210/169 |
| 3,372,809 | 3/1968 | Spitzer | 210/169 |
| 3,443,264 | 5/1969 | Miller | 210/169 X |
| 3,542,201 | 11/1970 | Belonger et al. | 210/169 |
| 3,616,918 | 11/1971 | Diemond | 210/169 |
| 3,749,244 | 7/1973 | Jannuzzi, Jr. | 210/169 |
| 3,859,214 | 1/1975 | Lang et al. | 210/169 |

*Primary Examiner*—Theodore A. Granger
*Attorney, Agent, or Firm*—Christie, Parker & Hale

[57] ABSTRACT

A skimmer filter and pumping unit for an above-ground swimming pool including portable pools in which a centrifugal pump is mounted on a base beside the pool. A cartridge-type filter unit having a cylindrical housing is supported from the base above the pump with the pump and cylindrical housing aligned along a common vertical axis. A skimmer unit is mounted on top of the filter unit and has an opening in the side adapted to open through the side of the pool adjacent the top of the pool when the base is resting on the ground. Water moves directly through the skimmer unit down through the filter into the pump, the pump dishcarge being connected back through the side of the pool below the skimmer.

1 Claim, 5 Drawing Figures

INTEGRAL PUMP SKIMMER AND FILTER UNIT FOR ABOVE-GROUND SWIMMING POOLS

FIELD OF THE INVENTION

This invention relates to filtering systems for above-ground swimming pools, and more particularly, is concerned with a combined integral pump, filter and skimmer unit vertically aligned on a common base for mounting beside an above-ground and portable pool.

BACKGROUND OF THE INVENTION

Recirculating systems for both below ground and above-ground swimming pools are well known. Generally water is withdrawn from the surface of the pool through a skimmer unit to withdraw surface water on which is floating dirt and other debris which accumulate on the surface of the water. Water from the skimmer is then strained to remove the larger materials and then passed to the intake of a centrifugal pump. The outlet from the pump is passed through a suitable filter for removing very fine particles which tend to cloud the pool water, the filtered water than being returned to the pool. The skimmer must be mounted on the side of the pool at the normal level of water, but the strainer, pump, and filter are generally mounted either in a remote area and connected to the pool through suitable pipes or mounted alongside the pool where they tend to be in the way and detract from the esthetic appearance of the pool area.

SUMMARY OF THE INVENTION

The present invention is directed to an improved filter system in which the skimmer, filtering unit and pump are arranged vertically in a slim, self-contained, unit which can be supported on the ground beside the above-ground pool and which takes up little more space than the upright posts of the pool. This is accomplished by combining the skimmer and filter in a common vertically extending fluid-tight housing which is axially aligned with and positioned directly above a vertically-mounted motor-driven centrifugal pump unit. While skimmers and filters have heretofore been combined in a single housing, no one to applicant's knowledge has heretofore provided a combined pump, filter, and skimmer system in an axially aligned vertically oriented arrangement that is completely self-contained with an inlet and an outlet connected directly to the side of the pool.

DESCRIPTION OF THE DRAWINGS

For a more complete understanding of the invention, reference should be made to the accompanying drawings, wherein.

DETAILED DESCRIPTION

Figure 1:
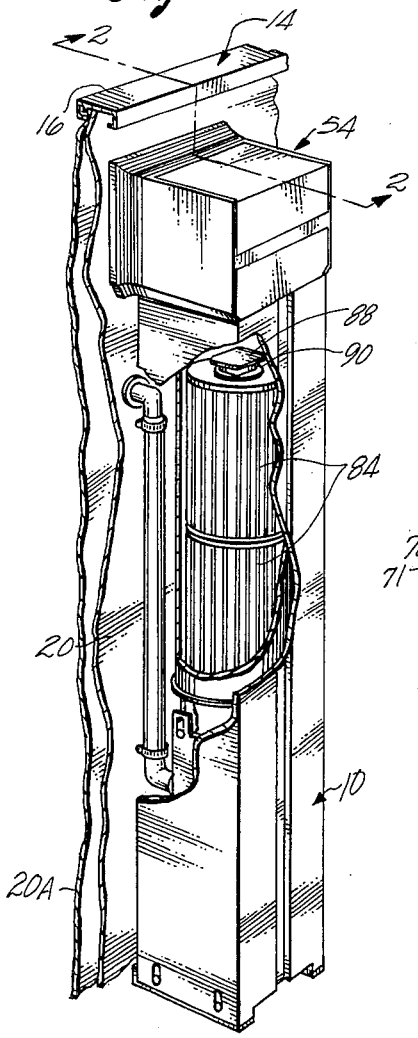
FIG. 1 is a perspective view partly cut away of the preferred embodiment of the invention.
Figure 2:
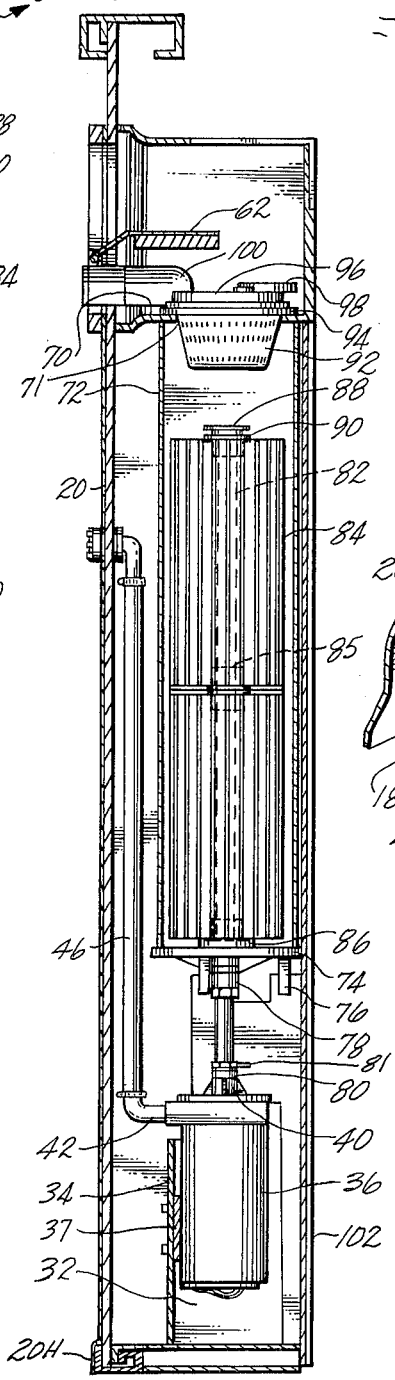
FIG. 2 is a cross-sectional view of the embodiment of FIG. 1.
Figure 3:
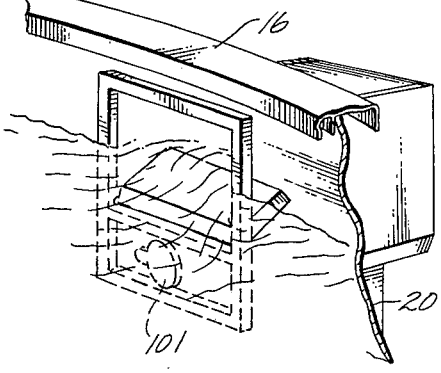
FIG. 3 is a perspective view of the skimmer intake.
Figure 4:
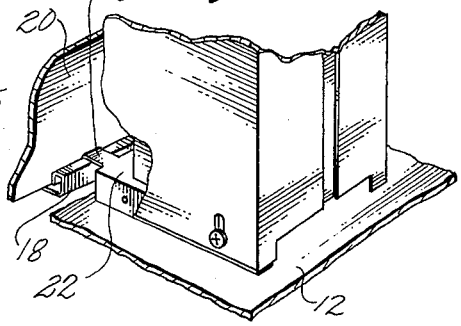
FIG. 4 is a perspective view of the mounting of the base of the unit.

Referring to the drawings in detail, the numeral 10 indicates generally the pumping and filtering unit of the present invention. The unit rests on a concrete pad or similar support 12 at ground level alongside an above-ground pool, indicated generally at 14. The pool typically includes an upper frame structure 16 forming the rim of the pool, a lower frame structure 18, and a side wall 20 extending between the upper and lower frame members 16 and 18 and a liner 20A made from vinyl or other suitable waterproof material. The above-ground pool 14 is of conventional construction.

The unit 10 is constructed with a heavy sheet metal base member 22 having channel-shaped legs 24 and 26 which rest on the pad 12. The base includes a pair of hook members 28 which extend from one edge of the base in a direction to hook over and engage the lower frame member 18 to securely hold the base 22 of the unit 10 in position adjacent the side of the pool. Projecting upwardly from the base 22 is a channel-shaped heavy gauge sheet metal support including two spaced parallel side walls 30 and 32 connected by an integral pump mounting plate 34. A centrifugal motor-driven pump unit 36 is bolted to insulating standoffs 37 which are in turn bolted to the pump mounting plate 34 with the axis of rotation of the pump unit extending in a vertical direction. A centrifugal pump 38 is positioned at the top of the pump unit 36, the pump 38 having a fluid inlet nipple 40 positioned along the vertical axis of the pump unit 36 and having a discharge nipple 42 at the perimeter. When the filter unit 10 is installed, the discharge nipple 42 is connected through an elbow 44, vertical riser pipe 46, an elbow 48, and through an opening in the side wall 20 of the pool. A suitable coupling, including an inner ring 50 and a pair of gaskets 52, clamp the elbow 48 to the side of the pool in a watertight connection. An adjustable inlet nozzle 50A can be rotated in the inner ring and held in a fixed position by retaining ring 50B so that the skimming pattern can be varied.

Figure 5:
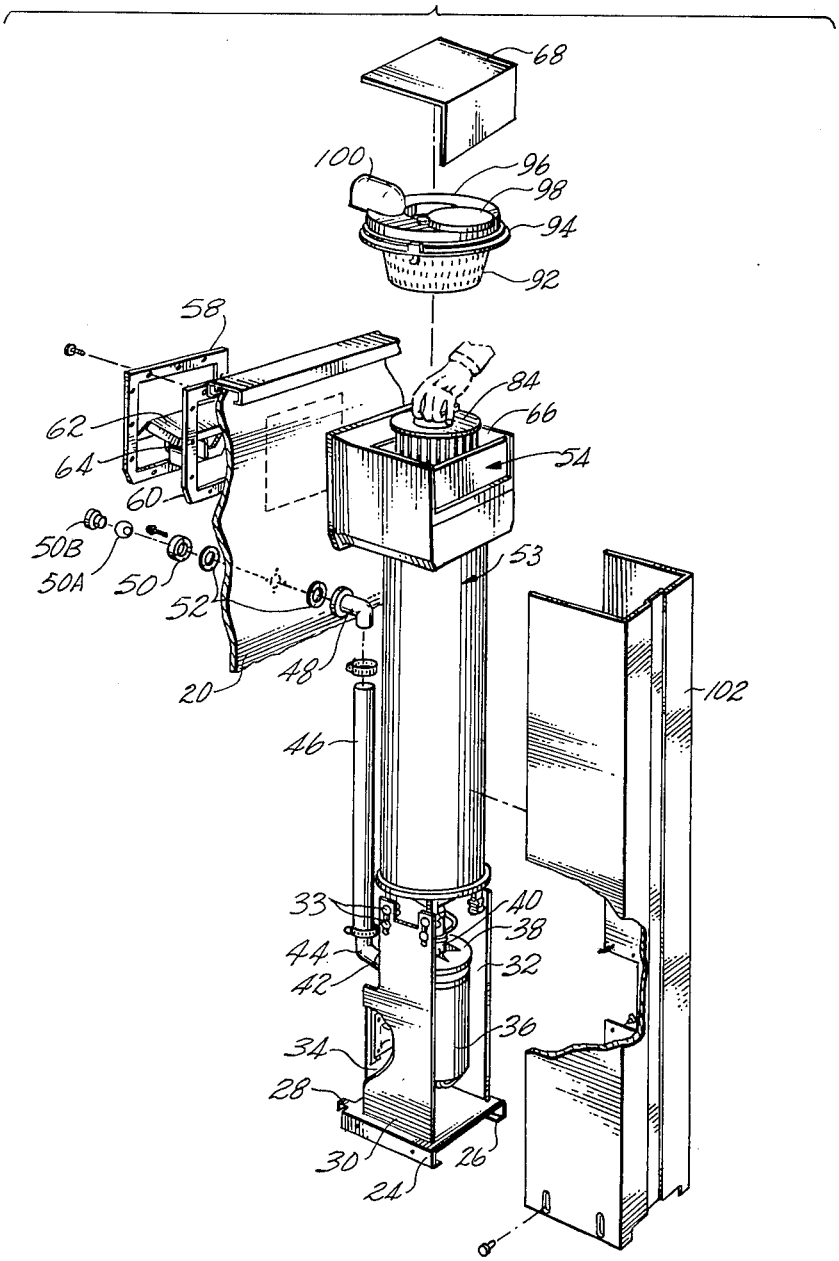
FIG. 5 is a perspective view showing the manner in which the strainer and filter are removed from the unit.

Mounted above the motor-pump unit 36 and adjustably supported by the side plates 30 and 32 by bolts 33 is a filter and skimmer assembly indicated generally at 53(FIG. 5). This assembly includes an upper substantially cubically shaped housing 54, one side of which is open to receive water from the pool. The open side of the housing 54 forms a rectangular surface 56 which fits against the side of the pool, the side of the pool being provided with an aligned rectangular opening. A rectangular frame member 58 is bolted to the open side of the housing 54 with a gasket 60 for clamping the housing to the side of the pool and providing a watertight connection. A floating weir 62 is mounted in the opening formed by the frame member 58 in hinged fashion which is conventional to pool skimmer design. Also a pool vacuuming hose connection 64 may be provided immediately below the opening in the frame 58 for use in vacuuming the pool.

The cubical housing 54 is open at the top, as indicated at 66, the top being normally covered by a lid 68. The bottom of the cubical housing 54, indicated at 70, has a circular opening 71 therein. A hollow cylindrical filter housing 72 is joined at its upper end to the bottom wall 70 of the cubical housing 54, such as by conventional thermoplastic bonding to form a watertight connection therebetween. The lower end of the cylindrical filter housing 72 terminates in a bottom wall 74 which includes integral mounting lugs 76 that are bolted or otherwise securely anchored to the side plates 30 and 32 of the base frame assembly. The bottom member 74 has a discharge nipple 78 which is fluid connected by a suitable coupler 80 to the intake nipple 40 of the pump unit 38. A gauge (not shown) is connected to pump outlet 81 which indicates when the cartridge needs cleaning.

A perforated standpipe 82 is bonded to a cartridge sealing sleeve which has an annular seal 86. On the other side of the seal, the lower end of the standpipe has an O-ring seal which slides in an opening in the bottom member 74. This permits cartridges 84 to be removed with the standpipe as an assembly. An alignment plate 85 seals between the two cartridges. The cartridge elements 84 are held in position on the standpipe by a knob 88 and sealed by an upper gasket plate 90, the knob 88 threadedly engaging the top of the standpipe 82. Thus water entering the housing 72 passes radially inwardly through the filter elements 84 and is drawn out through openings in the standpipe 82 into the intake of the pump 38. With the filter elements 84 in place, a strainer basket 92 is inserted above the filter element, the strainer basket 92 having a lip 94 around the top which engages the bottom wall 70 of the cubical housing 54, so that all water entering the filter housing 72 through the skimmer is screened through holes in the walls of the basket 92. The basket 92 is provided with a cover assembly 96. The basket is twist-locked to the cover assembly and then can be snapped into the circular opening in the cubical housing. This assures that the cover does not become separated and holds the cover in place during turbulent flows. A pivoted lid 98 may be used to close off the top of the basket to water entering through the skimmer. Water then can only enter the basket through a coupling 100 which engages the pool vacuuming coupling 64, for vacuuming the pool. The vacuum cap 101 and the pivoted lid 98 can be adjusted to control the amount of skimming action compared with the water drawn into the unit below the surface. This flow ratio also controls the weir height.

When mounted in position, the filtering unit is provided with a channel-shaped enclosure 102 of extruded thermoplastic or other suitable material which provides a decorative and protective cover for the pump and filter assembly. Thus it will be seen that a highly compact combined unitary skimmer filter and pump assembly is provided which can be mounted directly along the side of an aboveground pool. Because of the vertical arrangement of the pump and filter, the unit occupies a minimum of space. The unitary structure makes it easy to install yet convenient to service and maintain. At the same time the unit fits snugly against the side of the pool where it provides minimum interference with use of the pool, while at the same time eliminating need for special piping to connect the unit to the pool.

What is claimed is:

1. A pump and filter unit for mounting on an aboveground swimming pool having a sidewall with a filtered-water inlet opening and a skimmer outlet opening, the unit being adjustable in height to compensate for variations in spacing of the skimmer outlet opening above a lower edge of the pool sidewall, the unit comprising:

a base having hook means extending therefrom and configured to engage the lower edge of the pool sidewall to secure the base to the pool;

a support bracket secured to and extending upwardly from the base;

a pump-and-motor assembly having a pump and motor which are coupled together and arranged vertically one above the other, the pump and motor being secured to the support bracket and having rotation axes which are substantially vertical, the pump having fluid inlet and outlet fittings;

a filtered-water delivery pipe having one end connected to the pump outlet fitting and having a second end adapted for connection to the pool sidewall at the sidewall filtered-water inlet opening;

an upright cover enclosing the pump-and-motor assembly and being releasably secured to the support bracket to enable access to the pump and motor without requiring removal of the unit from the pool;

an upright cylindrical filter housing disposed above the pump-and-motor unit, the filter housing having a closed lower end and an open upper end, the housing including an outlet conduit sealed to and extending through the lower end of the filter housing, the conduit having a lower end connected to the pump inlet fitting;

a filter element supported in the filter housing and having a permeable outer surface permitting filtering flow of water through the outer surface into the interior of the filter element;

means of the lower end of the filter element for coupling the interior of the element of the filter-housing outlet conduit to enable flow of filtered water to the pump;

a skimmer housing secured to the open upper end of the filter housing, the skimmer housing having a bottom wall with an opening therethrough permitting fluid flow into the filter housing around the filter element, and having a side surface adapted for connection to the pool sidewall, the side surface having an opening therethrough for alignment with the pool skimmer outlet opening;

a buoyant weir member movably mounted along its lower edge on the skimmer housing to position the weir member for floating movement of the upper edge of the member in the skimmer housing;

a perforate strainer basket supported at the bottom wall of the skimmer housing over the open upper end of the filter housing for collecting debris in water received through the skimmer-housing side-surface opening and flowing over the weir downwardly into the filter housing; and adjustable connection means on the filter housing and the support bracket for securing the filter housing to the bracket at a variable spacing from the base to enable alignment of the skimmer-housing side-surface opening with the pool-sidewall skimmer outlet opening when the base is secured by the hook means to the lower edge of the pool sidewall.

* * * * *